US005225826A

United States Patent [19]

DeLuca et al.

[11] Patent Number: 5,225,826

[45] Date of Patent: Jul. 6, 1993

[54] VARIABLE STATUS RECEIVER

[75] Inventors: Joan S. DeLuca; Michael J. DeLuca, both of Boca Raton, Fla.

[73] Assignee: Motorola, Inc., Schaumburg, Ill.

[21] Appl. No.: 742,220

[22] Filed: Aug. 6, 1991

Related U.S. Application Data

[63] Continuation of Ser. No. 402,936, Sep. 5, 1989, abandoned.

[51] Int. Cl.[5] ..... H04B 7/00

[52] U.S. Cl. ..... 340/825.44; 340/311.1; 340/825.47; 340/825.48

[58] Field of Search ..... 340/825.44, 825.46, 340/825.47, 825.48, 309.4, 309.15, 309.5, 311.1; 455/31, 32, 38

[56] References Cited

U.S. PATENT DOCUMENTS

| | | | |
|---|---|---|---|
| 4,383,257 | 5/1983 | Giallanza et al. | 340/825.47 |
| 4,839,641 | 6/1989 | Mori et al. | 340/825.48 |
| 4,851,829 | 7/1989 | DeLuca et al. | 340/825.44 |
| 4,860,005 | 8/1989 | DeLuca et al. | 340/825.44 |
| 4,872,005 | 10/1989 | DeLuca et al. | 340/825.46 |
| 4,894,649 | 1/1990 | Davis | 340/309.4 |
| 4,896,306 | 1/1990 | Sanbongi et al. | 368/41 |
| 4,910,510 | 3/1990 | Davis et al. | 340/825.44 |

*Primary Examiner*—Donald J. Yusko
*Assistant Examiner*—Dervis Magistre
*Attorney, Agent, or Firm*—Daniel R. Collopy; William E. Koch; Thomas G. Berry

[57] ABSTRACT

A selective call receiver, such as a pager, has a real-time clock and is capable of determining the response of the receiver to a message in accordance with a status associated with that message. The selective call receiver can also change the status at a selected time or if a characteristic of the message matches a predetermined characteristic. Additionally the selective call receiver may choose from a plurality of priorities, a priority of a received message in order to determine if a message stored in the memory of the selective call receiver will be deleted by the received message. The selective call receiver is further capable of determining the type of data decoded by an address with respect to the time of day.

45 Claims, 9 Drawing Sheets

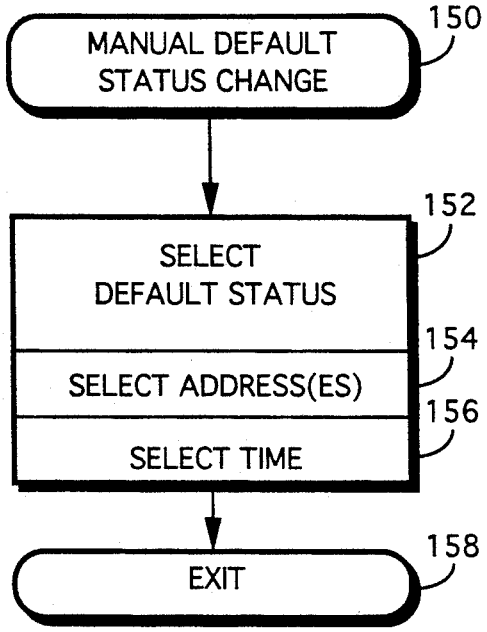
FIG. 6
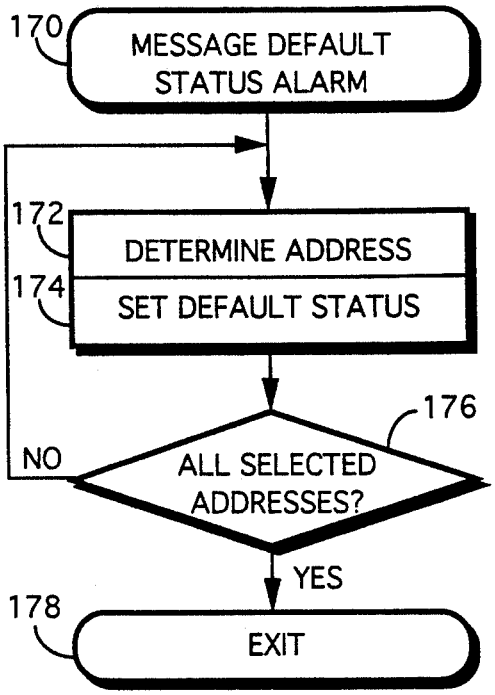
FIG. 8
| | TIME | ADDDRESS | MESSAGE STATUS |
|---|---|---|---|
| 162 | 8:00A | A & C | 1 HELD<br>0 ALERTED<br>0 LOCKED<br>0 PROTECT<br>0 READ<br>0 DELETED |
| 162 | 10:00A | A & C | 0 HELD<br>0 ALERTED<br>0 LOCKED<br>1 PROTECT<br>0 READ<br>0 DELETED |
| 162 | - - | D | 0 HELD<br>0 ALERTED<br>0 LOCKED<br>0 PROTECT<br>0 READ<br>1 DELETED |
FIG. 7

| | TIME | ADDDRESS/ MESSAGE | CONDITIONAL STATUS | NEW STATUS |
|---|---|---|---|---|
| 220 | 10:10A | A & C | 1 HELD<br>X ALERTED<br>X LOCKED<br>X PROTECT<br>X READ<br>X DELETED | 0 HELD<br>X ALERTED<br>X LOCKED<br>X PROTECT<br>X READ<br>X DELETED |
| 222 | 5:05P | 2 | X HELD<br>X ALERTED<br>X LOCKED<br>X PROTECT<br>X READ<br>X DELETED | 0 HELD<br>0 ALERTED<br>0 LOCKED<br>0 PROTECT<br>0 READ<br>1 DELETED |
| 224 | 11:00P | ALL | 0 HELD<br>1 ALERTED<br>0 LOCKED<br>0 PROTECT<br>1 READ<br>0 DELETED | 0 HELD<br>0 ALERTED<br>0 LOCKED<br>0 PROTECT<br>0 READ<br>1 DELETED |
| 226 | 11:30P | ALL | 0 HELD<br>1 ALERTED<br>0 LOCKED<br>1 PROTECT<br>0 READ<br>0 DELETED | 0 HELD<br>1 ALERTED<br>0 LOCKED<br>0 PROTECT<br>1 READ<br>0 DELETED |

*FIG. 10*

STATUS OF MESSAGE STORED IN MEMORY

| | HELD | ALERTED | LOCKED | PROTECT | READ | DELETED |
|---|---|---|---|---|---|---|
| 264 | X | X | X | X | X | 1 |
| 266 | 0 | 1 | 0 | 0 | 1 | 0 |
| 268 | 0 | 1 | 0 | 0 | 0 | 0 |
| 270 | 0 | 1 | 0 | 1 | X | 0 |
| 272 | 1 | X | X | X | X | 0 |
| 274 | X | 0 | X | X | X | 0 |
| | X | X | 1 | X | X | 0 |

250

STATUS OF RECEIVED MESSAGE NECESSARY TO DELETE STORED MESSAGE

| HELD | ALERTED | LOCKED | PROTECT | READ | DELETED |
|---|---|---|---|---|---|
| X | X | X | X | X | 0 |
| X | X | X | X | 0 | 0 |
| X | X | X | 1 | X | 0 |
| 1 | X | X | 1 | X | 0 |
| NONE | | | | | |
| NONE | | | | | |
| NONE | | | | | |

260

*FIG. 12A* *FIG. 12B*

| 300 | 302 | 304 | 306 | 308 |
|---|---|---|---|---|
| TIME | FUNCTION | TIME | FUNCTION | ADDRESS |

*FIG. 13*

| 320 | 322 | |
|---|---|---|
| FUNCTION | FORMAT | |
| 0 0 0 0 | TONE ONLY | NO PRIORITY |
| 0 0 0 1 | NUMERIC | NO PRIORITY |
| 0 0 1 0 | ALPHA | NO PRIORITY |
| 0 0 1 1 | GRAPHIC | NO PRIORITY |
| 0 1 0 0 | TONE ONLY | PRIORITY |
| 0 1 0 1 | NUMERIC | PRIORITY |
| 0 1 1 0 | ALPHA | PRIORITY |
| 0 1 1 1 | GRAPHIC | PRIORITY |
| 1 0 0 0 | VOICE | ANALOG |
| 1 0 0 1 | VOICE | LPC |
| 1 1 1 1 | INACTIVE | INACTIVE |

*FIG. 14*

| 330 | 332 | 334 | 336 | 338 | 340 | 342 |
|---|---|---|---|---|---|---|
| 8:00A | 0110 | 5:00P | 0001 | 11:30P | 1111 | 555-1212 |

*FIG. 15*

VARIABLE STATUS RECEIVER

This is a continuation of application Ser. No. 07/402,936 filed on Sep. 5, 1989, now abandoned.

BACKGROUND OF THE INVENTION

This invention relates to a selective call receiver, such as a pager, which has the ability to store and respond to different messages, either at the time of receipt of such messages or at a subsequent time, in accordance with a status associated with that message. The invention also relates to a method of operation of such a selective call receiver.

SUMMARY OF THE PRIOR ART

Today, paging services offered to customers are becoming more and more sophisticated. To keep track with these services, more sophisticated page handling features and page types are required in the pagers of users subscribing to such services.

Existing pagers assign a predetermined status to a received message and store the received message in memory. The status of the message determines the manner in which the pager is to respond to that message, either at the time of receipt of the message, or at some future event time, such as when the user reads the message onto the screen, or when another message is received. The message status is a digital word including bits indicative of the following conditions: alerted/unalerted, protected/unprotected, read/unread and present/deleted. A pager with such an operation is shown in U.S. Pat. No. 4,851,829 to DeLuca et al, which is assigned to the assignee of the present invention and which is hereby incorporated by reference. An unalerted message is a message which has been received and needs to have an alert signal generated to indicate to the user that the message has been received. Upon generating an alert associated with the message the status changes to alerted. An unread message is one which has not yet been displayed on the pager display. Upon reading the unread message, the status is changed to the read status. When a message has a protected status, this can indicate that it is not to be overwritten by new incoming messages. Alternatively, the protected/unprotected status of a message may determine under what circumstances the message can be deleted by the user. For each of the aforementioned aspects of a message status, the response of the receiver to the message is controlled in accordance with the status.

It is known to provide a pager having a time of day clock, the pager being capable of reminding a user of an important message event, such as a pager in which an alert signal is issued at a time determined by the time of day clock. Such a pager is described in U.S. Pat. No. 4,872,005 to DeLuca et al. and assigned to Motorola Inc., said patent hereby incorporated by reference.

It is also known to control power-on times and power-off times of a pager in accordance with a time of day clock. Such a pager is described in U.S. Pat. No. 4,860,005, to DeLuca et al. and assigned to Motorola Inc., said patent also hereby incorporated by reference.

As pagers and paging systems become more widely used, and the throughput of messages increases very rapidly, an increasingly greater burden is placed on the pager user in such respects as remembering what messages are stored in the pager and the efficient management of the messages stored within the pager memory.

It is often important that a stored message should not be overlooked, but as the rate of receipt of messages increases, a user is increasingly less encouraged to keep track of the received messages. On the other hand, for most messages, there comes a point where the message is so out of date that the message merely clutters up the memory and makes the user's task more difficult. Additionally, it is desirable to provide a means for not receiving messages which are not important to the user. Furthermore it is important to keep message management a relatively simple task for the pager user in view of increasing message throughput.

It is therefore an object of the present invention to provide an improved pager, which alleviates some or all of the aforementioned problems.

SUMMARY OF THE INVENTION

In carrying out the objects of the invention in one form, there is provided a selective call receiver comprising means for receiving a selective call message at a first time. The selective call message comprises an address, a message and message status information. The selective call receiver also comprises means for storing the messages and a message status associated therewith and means for handling the message in accordance with the message status. The selective call receiver further comprises means for automatically changing the message status to one of a plurality of predetermined message statuses, the one of the plurality of predetermined message statuses determined in response to the message status information. After the automatic changing means automatically changes the message status to the one of the plurality of predetermined message statuses, the message handling means thereafter handles the message in accordance with the one of the plurality of predetermined message statuses.

BRIEF DESCRIPTION OF THE DRAWINGS

FIG. 6 shows a flowchart for setting the predetermined default status of a message used in step 104 of FIG. 4.

FIG. 7 shows a table generated by the flowchart of FIG. 6.

FIG. 8 shows a flowchart for changing the default status used in FIG. 4 in response to the time of day.

FIG. 10 shows a table of times generated by the flowchart of FIG. 9 for changing the status of messages stored in the message memory.

FIGS. 12A and 12B show truth tables illustrating the status of a received message necessary to delete messages of various statuses from the message memory.

FIG. 13 shows a address signal stored in the code plug with corresponding functions time and function signals.

FIG. 14 shows a table relating the function signal to the type of message received by the pager.

FIG. 15 shows an example of the changing functions of an address with respect to time.

DETAILED DESCRIPTION OF A PREFERRED EMBODIMENT

In order to best illustrate the utility of the present invention, it is described in conjunction with a communication receiver, such as a paging receiver, capable of receiving and decoding selective call signals, the selective call signals including at least one data message. While the present invention is described hereinafter with particular reference to a paging receiver, it is to be understood at the outset of the description which follows, it is contemplated that the apparatus and method, in accordance with the present invention, may be used with numerous other communication receivers.

The paging receiver herein is associated with a paging system having a base station terminal. The receiver responds to control and data information from the base station terminal, and in turn stores and provides data messages to a user during operation.

Figure 1:
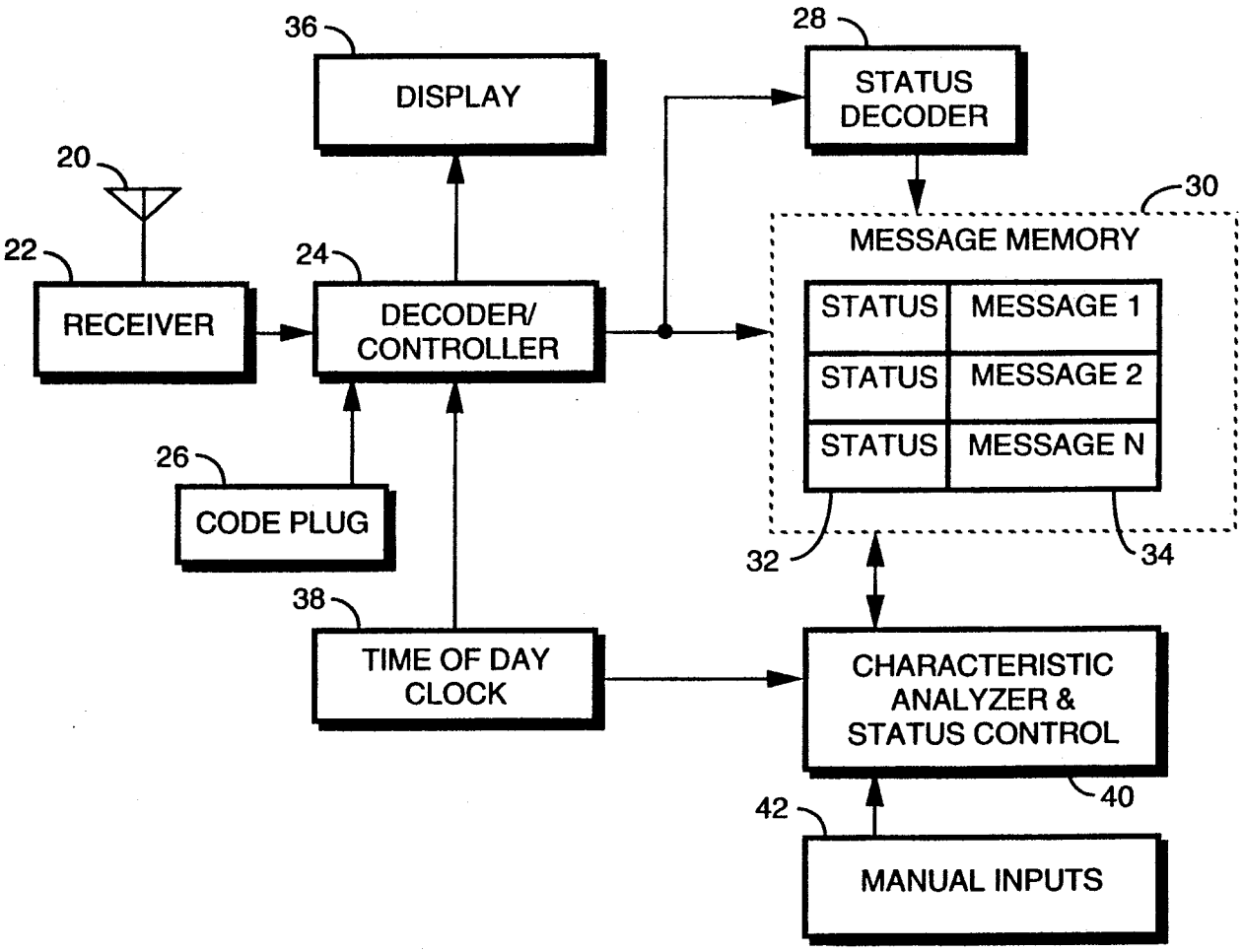
FIG. 1 illustrates the block diagram of a paging receiver operating in accordance with the present invention.

FIG. 1 illustrates the block diagram of a paging receiver 10 operating in accordance with the present invention. Radio frequency modulated selective call paging signals are received on antenna 20 demodulated by receiver 22 and decoded by decoder 24. Decoder 24 compares address signals within the selective call signal with at least one predetermined address signal stored within code plug 26. In response to detecting an address assigned to the pager, a message signal following the address is processed. Status decoder 28 determines if the message signal includes status and timing information and stores said information in a status area 32 within message storage memory 30. If no initial status information is included, a default status is assigned to the message. The message information is stored in a message area 34 within message memory where each message has a corresponding status signal. The pager also has a display 36 for displaying message information as well as time of day information as determined by a time of day clock 38. Time of day clock 38 may also provide day and date information and is capable of generating alarms in response to the time of day being equal to a time set by various functions of the pager. The status of messages stored in message memory may be changed by characteristic analyzer and status control means 40 in response to the time of day clock 38 or under manual control from manual inputs 42 which may include a plurality of buttons for manually operating various functions of the pager. Decoder 24 further analyzes the status assigned to a received message and the statuses of messages stored in the message memory 30 and determines which messages if any are to be deleted in order to store the message, or if the received message will be stored.

An enabling description of the invention may be realized with the aforementioned incorporated references and the figures describing the operation of the invention.

Figure 2:
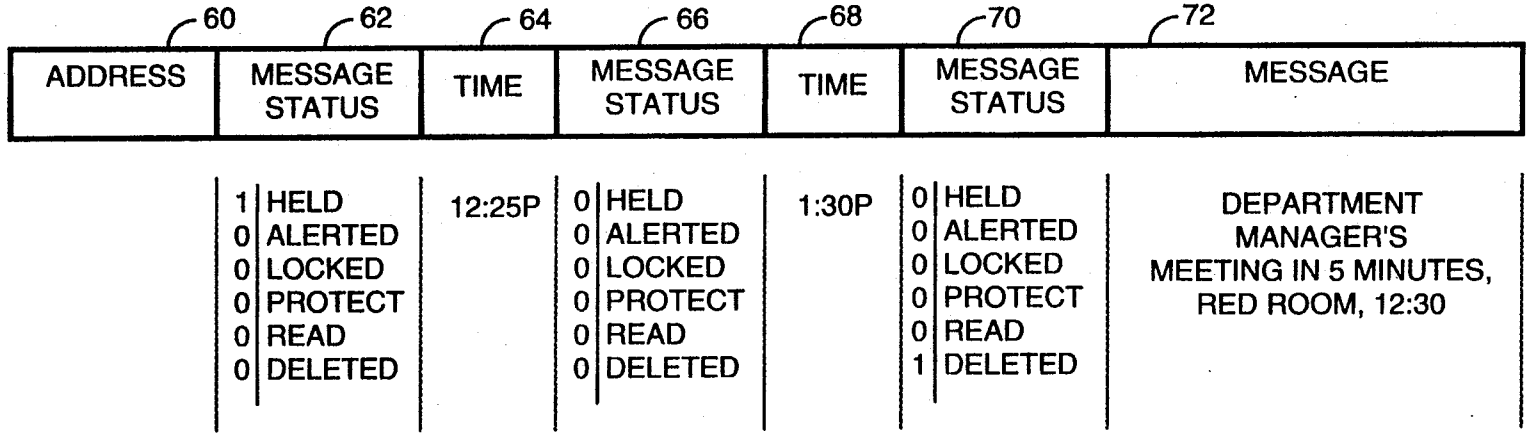
FIG. 2 shows an example of a message signal having various status signals and message information.

FIG. 2 shows an example of a message signal having various status signals and message information. The message signal is preceded by an address 60. The message signal consists of a first message status signal 62 which indicates a default status, followed by a time signal 64 and a corresponding second status signal 66, followed by a time signal 68 and a corresponding third message status 70 and followed by a message 72. The message 72 is "DEPARTMENT MANAGER'S MEETING IN 5 MINUTES, RED ROOM, 12:30". The message signal provides for establishing a default status for the message and changing the status of the message at two times during the day.

The message status as indicated by the status signals 62, 66, and 70 comprise six bits indicating a state of a corresponding status. The first status "HELD" indicates if the message is available for alerting and reading. A "0" for this status indicates the message is not held and a "1" for this status indicates the message is held. The held message provides no indication to the user that the message resides within the pager (except that a message received with the held status may delete messages of a lower status), thus the user may not read a message with a held status.

The "ALERTED" status indicates if an alert is to be generated for the message. Purposes for the alert include indicating the reception of the message and indicating a status change of the message. A "0" indicates that an alert is to be generated and a "1" indicates than an alert is not to be generated. In the normal operation of the pager having a multi-tasking microcomputer (as described in the aforementioned patents), the status of each message is periodically scanned and if a message has a "0" status for held (not held) and a "0" status for alerted, an alert is generated for the message. After completion of the alert, the alerted status is changed to a "1".

The "LOCKED" status indicates the message may not be deleted by an incoming message, or by a time executed status change. This provides the user with a way to insure that a message is never erased from memory by an automatic operation and that only a manual deletion may remove the message from memory. A "0" indicates the message is not locked while a "1" indicates the message is locked.

The "PROTECT" status indicates the message is protected from deletion by an incoming message, but may be deleted by a time executed status change. This insures that a message is not erased by an incoming message having a lower status but may be erased by an automatic operation or manual deletion. A "0" indicates the message is not protected while a "1" indicates the message is protected.

The "READ" status indicates if the message has been read by the user of the pager. A "0" indicates the user has not read the message. After reading a message, the status is set to a "1". This status is used for determining deletion priority of a message in response to an incoming message or to generate an "unread message alert" if the pager is switched off with unread messages.

The "DELETED" status indicates if the message is present in the pager. A "0" indicates the message is present and a "1" indicates the message is deleted.

The aforementioned statuses control the way a message is handled by the pager. The message of FIG. 2 is received with a default status indicating the message is held, status signal 62. Thus the message is stored in memory and no indication is given to the user that the message has been received. For example, the message of FIG. 2 may have been sent at 8:30 in the morning. Time signal 64 indicates that at 12:25 PM the message status is to be changed to correspond to status signal 66 which releases the message from the held state. Consequently an alert is generated in response to which the pager user reads the message indicating a meeting will occur at 12:30 PM. The message remains in the pager until 1:30 PM when time signal 68 causes the message to be deleted as indicated by status signal 70. Thus the message was sent to the pager substantially prior to the meeting, an alert was generated only prior to the meeting, and the message was deleted substantially after the beginning of the meeting. The message did not clutter the user operations of the pager until just prior to the meeting. The sequence management by the pager user.

Figure 3:
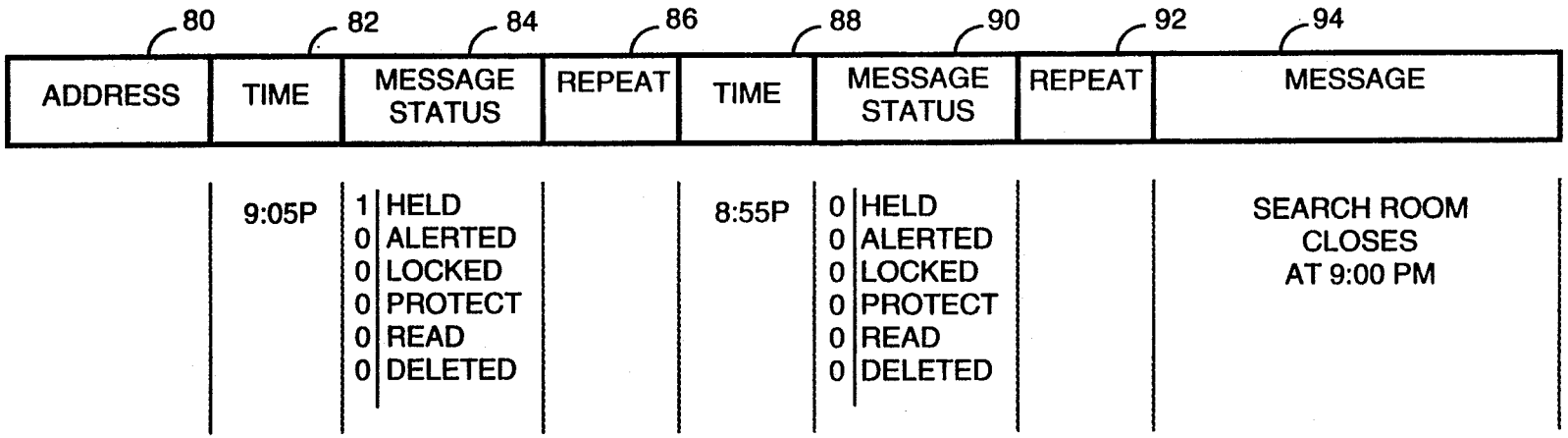
FIG. 3 shows another example of a message signal.

FIG. 3 shows another example of a message signal. Following the address 80 is a time signal 82. The absence of a status signal after the address, as in address signal 62, indicates a predetermined default status is to be assigned to the message. However, at 9:05 PM, as determined by time signal 82, the message status is changed to "HELD", thereby making the message inaccessible to the user. Following message status 84 is a repeat signal indicating that the status change of signal 84 is to be executed every time the time of day clock equals time signal 82. Time signal 88 indicates that at 8:55 PM the message status is to be changed to correspond to message status signal 90. The message status is changed to "UNHELD" and "UNALERTED" thereby causing the pager to generate an alert. In response to the alert, the user would read the message 94, "SEARCH ROOM CLOSES AT 9:00 PM". Repeat signal 92 indicates that every time the time of day clock 38 equals time 88, the status of the message is changed to correspond to message status signal 90.

Thus the message signal of FIG. 3 is first received and alerted using a default priority. Thereafter, the message is alerted every day at 8:55 PM and held every day at 9:05 PM. The message appears in the user memory for ten minutes and is held the rest of the day thereby uncluttering the message from the user selection process and simplifying the operation of the pager.

It should be appreciated that the time signals of FIGS. 2 and 3 may also include day of week and date information thereby causing the status of messages to be changed additionally in response to this information. It should be further appreciated that message status and time signals of FIGS. 2 and 3 may be distinguished from the message by the use of predetermined control characters. Alternately, the status and time signals may be placed anywhere after the address signal. The messages status signal of FIGS. 2 and 3, 60–70 and 82–86 along with a signal corresponding to a addresses 60 and 80 are stored in status area 32 of the message memory and the messages 72 and 94 are stored in message area 34 within the message memory.

Figure 4:
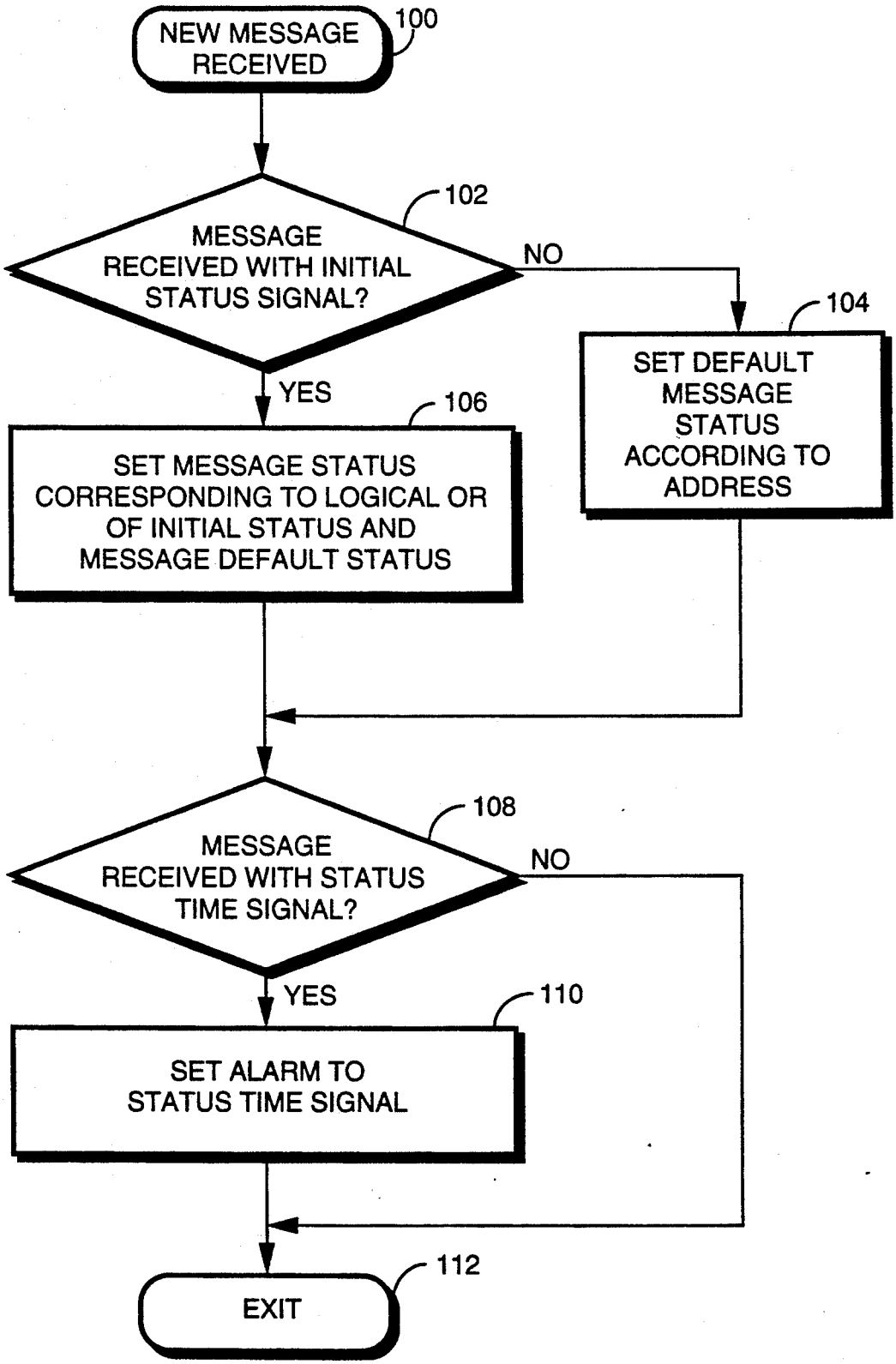
FIG. 4 shows a flowchart for assigning a default status to a message received by the pager and setting a time for changing the status of the message.

FIG. 4 shows a flowchart for assigning a default status to a message received by the pager and setting a time for changing the status of the message. In step 100, a new message is received. Step 102 checks if the message was received with an initial status. If no initial status was received (the signal of FIG. 3), a predetermined default status is assigned to the message in step 104. The predetermined default status may be permanently stored in code plug 26 or selected by means 42 in combination with time of day signals. The default status may further be dependent upon the address received with the message signal. If in step 102, an initial status signal is received (signal 62 of FIG. 2), step 106 sets the default status. In the preferred embodiment, step 106 performs the logical "OR" of the received initial status with the default status associated with the address preceding the message signal. Thus if the default status of messages associated with an address are "HELD", the received status would not clear the "HELD" status. The initial status is then deleted from the message signal. It should be appreciated that in an alternate embodiment, the message status of step 106 could be always set to correspond to the status received in the message signal. Furthermore, default status dependency based upon the address in steps 104 and 106 could be eliminated, thereby assigning a default status to all addresses. From either step 104 or 106, step 108 checks if the message was received with a time signal. If true, step 110 sets an alarm in time of day clock 38 to correspond to the time signal. Finally, step 112 exits to the other operations of the pager.

Figure 5:
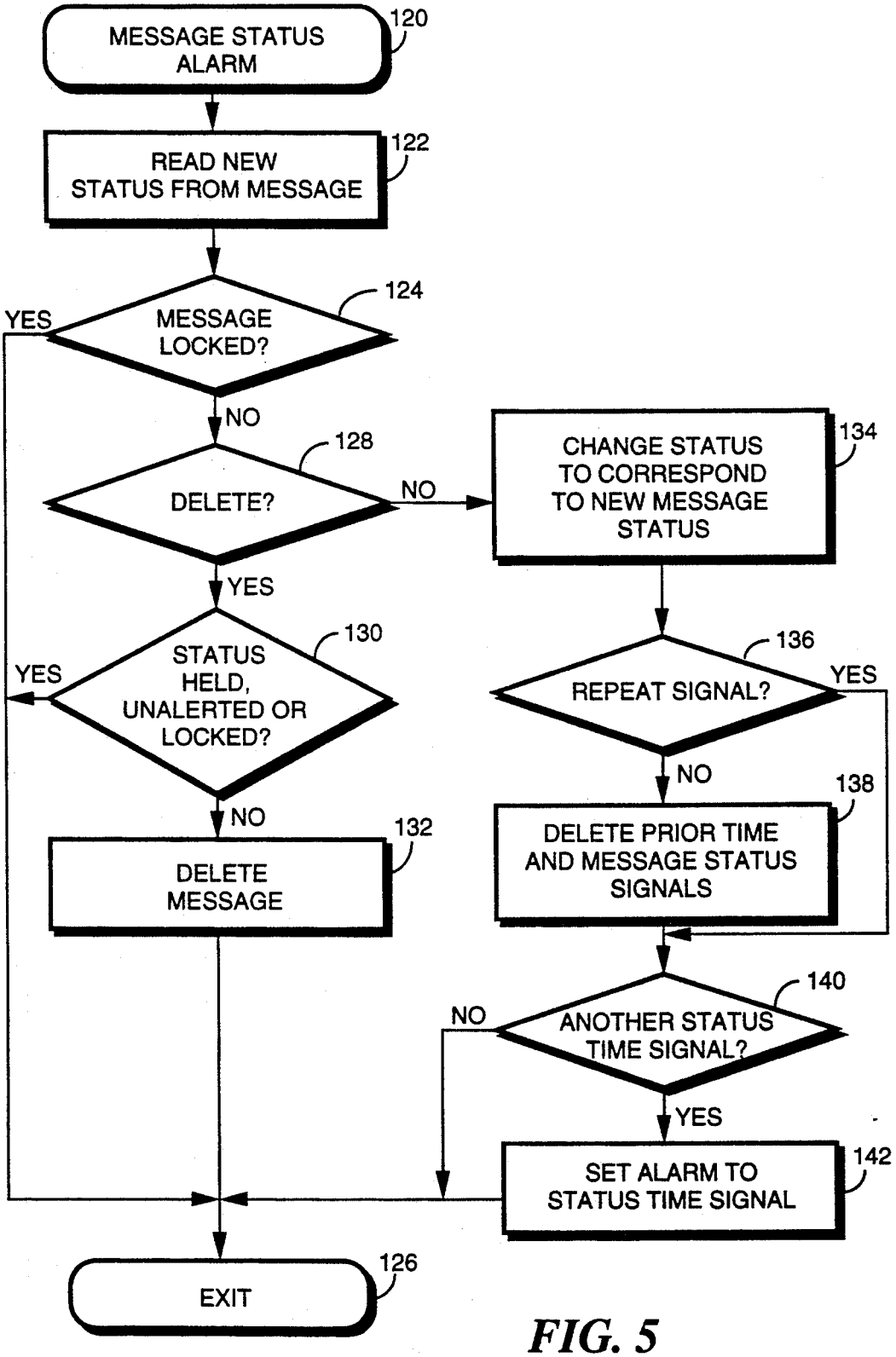
FIG. 5 shows a flowchart for changing the status of a message in response to signals within the message.

FIG. 5 shows a flowchart for changing the status of a message in response to signals within the message. In step 120, a message status alarm is generated by time of day clock 38, as set by step 110 of FIG. 4. In step 122, the message corresponding to the alarm is determined and the new status corresponding to the alarm is read from the message memory. Step 124 determines if the message has been locked, thereby prohibiting the automatic changing of the status of the message. If true, step 126 exits to other operations of the pager. If unlocked, step 128 checks if a new status causes the message to be deleted. If true step 130 checks if the current status corresponds to held, unalerted or locked. If false, the message is deleted in step 132 and in step 126 other operations of the pager are executed. If true, step 126 is directly executed. Thus a message may not be deleted if it is either unread, held or locked. If in step 128 the result was false, step 134 changes the status of the message to correspond to the new message status. Then in step 136, a repeat signal is checked to be associated with the time and status signal. If not found, the time and status are deleted. Then in step 140, the message is checked for the next time signal subsequent to the time of day clock, and if found, step 142 sets the alarm to correspond to the time signal and step 126 returns to other pager functions. Subsequently, step 120 is again executed in response to the time of day clock being equal to the alarm set in step 142. Thus the pager may modify the status of a message having time and status signal as shown by FIGS. 2 and 3. It should be appreciated, that in view of this disclosure, many permutations and combinations may be made in modifying the status of a message while remaining within the scope of the invention.

FIG. 6 shows a flowchart for setting the predetermined default status of a message used in step 104 of FIG. 4. The flowchart is entered at step 150 which may be made in response to a manual input from means 42. In step 152, the default status is selected from the available message statuses. The selection would also be made in response to manual inputs from means 42. After selecting the status, an address corresponding to the status is selected at step 154. Either a single address, or any combination of addresses, or all addresses stored in the code plug may be selected to correspond to the default status of step 152. Then in step 156 a time for implementing the status is selected. The time selected in step 156 is programmed into the alarm of the time of day clock. In an alternate embodiment, this step may be eliminated thereby making the default status effective immediately. Furthermore, if a default status is not selected by FIG. 6, it may be stored in the codeplug thereby allowing selection at the time of programming the pager addresses.

FIG. 7 shows a table generated by the flowchart of FIG. 6. The table may be stored in memory within characteristic analyzer and status control means 40. Table entry 162 shows that at 8:00 AM the default status associated with address "A" and "C" stored in the code plug correspond to the held status. Entry 164 shows that 10:00 AM the default status of "A" and "C" changes to the protected status. Table entry 166 has no associated time and is thereby always in effect for address "D". This status causes any message received on address "D" to be deleted upon reception.

FIG. 8 shows a flowchart for changing the default status used in step 104 of FIG. 4 in response to the time of day. In response to an alarm programmed in step 156, step 170 is entered. Step 172 determines an address associated with the alarm and step 174 changes the default status associated with the address. Then step 176 checks if all addresses selected by step 154 have had their default statuses changed. If false, step 172 is again executed. If true, step 178 exits to other pager functions.

The pager operating in accordance with FIGS. 6–8 will hold messages received on address "A" and "C" between 8:00 AM and 10:00 AM. This time may correspond to the pager user being in an important meeting, and thus not wanting to be disturbed by the reception of the messages on these addresses. Messages received after 10:00 AM will be alerted upon reception and automatically protected from deletion by an incoming message. Messages received on address "D" will be arbitrarily deleted upon reception and no alert generated. Such messages may be received from one who the pager user has an adversarial relationship. The default status of messages received on address "D" may be manually changed at a later date if desired. The pager may also have a "B" address stored in the code plug. The default status could be either predetermined or stored in the codeplug. If the default status corresponded to all "0"s in the corresponding status states, messages received on this address would always be alerted upon reception, even in the aforementioned time between 8:00 AM and 10:00 AM where messages associated with address "A" and "C" were held, thereby unalerted.

Figure 9:
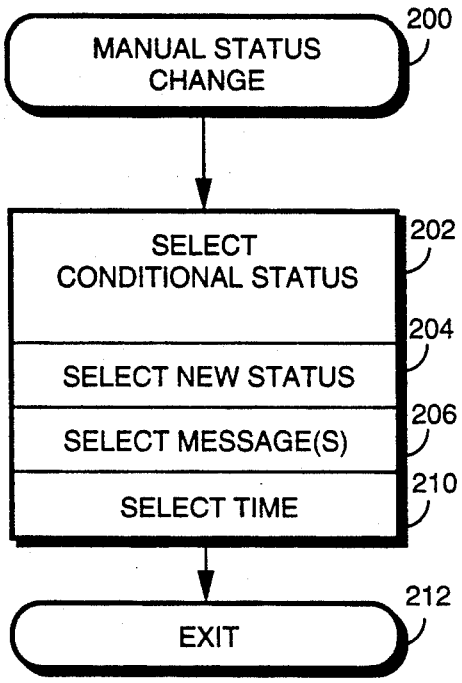
FIG. 9 shows manually changing the status of messages received and stored in the message memory in response to the characteristic of the message.

FIG. 9 shows manually changing the status of messages received and stored in the message memory in response to the characteristic of the message. The characteristic of the messages may include the status of the message, the message number, and the address on which the message was received. In step 200, the manual status change mode is entered in response to manual input from means 42. In step 202, a conditional status is selected, this status indicates the status of messages necessary before the status may be changed. Then in step 204, the new status is selected. In step 206 messages for status change are selected. In step 210 a time for the status change is selected and programmed into an alarm within the time of day clock. Then step 212 exits to other paging functions. As in the flowchart of FIG. 6, the selections of steps 202, 204 and 206 may be made in response to manual inputs made on means 42 of FIG. 1. Steps 206 and 210 may be eliminated thereby providing convenient operations on a plurality of messages. For example, the conditional status of step 202 may include all messages having the read status and the new status may cause all messages having the read status to be deleted from the pager memory. In this example, protected, locked, unalerted or held messages may not be deleted. This frees the user from the task of individually deleting read messages. Alternately the conditional status may include all messages having the held status and the new status would change the held messages to unalerted messages. In the example of FIGS. 6 through 8, this could be used between 8:00 AM and 10:00 PM to determine if any messages were received on address "A" or "B". Furthermore, held messages could be changed to an unheld and alerted status, thereby forgoing the alert sequence and making the messages available for reading by the user. It should be further appreciated that step 206 may be executed and only held messages received on address "A" would be changed to an unheld status, thereby keeping messages received on address "C" in a held status.

FIG. 10 shows a table of times generated by the flowchart of FIG. 9 for changing the status of messages stored in the message memory. The table may be stored in memory within means 40 of FIG. 1. Table entry 220 shows that at 10:10 AM the status of messages received on addresses "A" and "C" may be changed. The conditional status corresponds to the "HELD" state equaling a "1" and all other status states are "don't care" states. The new status corresponds to the "HELD" state being cleared, and not changing the state of the remaining statuses, thus making any held messages received on addresses "A" or "C" received prior to 10:00 AM available for alerting. When combined with the example of FIGS. 6–8, entry 220 changes the held state of messages received between 8:00 AM and 10:00 AM at 10:10 AM. Entry 222 shows that at 5:05 PM message 2 (which corresponds to the order in which the message was received) has no conditional status required in order to change to a deleted status. Thus entry 222 provides for deleting message number 2 at 5:05 PM. Entry 224 shows that at 11:00 PM all messages having alerted and read statuses set and other states clear will have a status of deleted, thereby removing the message from the pager memory. And entry 226 shows that at 11:30 PM all messages having the alerted protect, and read statuses set will have the protect status cleared thereby providing for deletion of the message by an incoming message.

Figure 11:
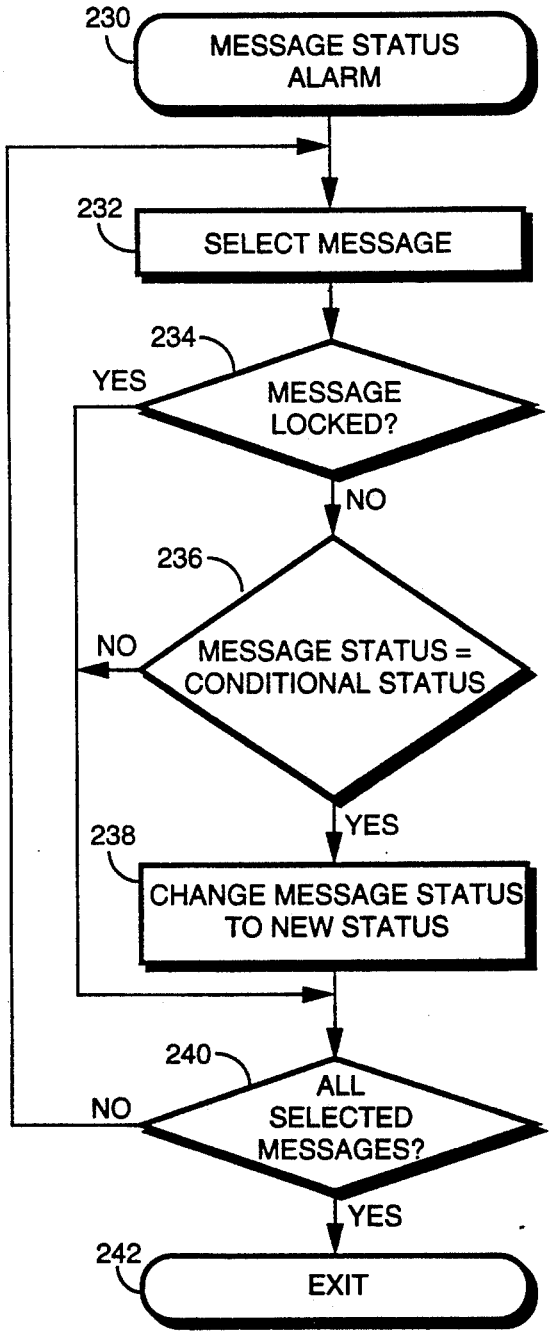
FIG. 11 shows a flowchart for changing the status of a message in response to the table of FIG. 10.

FIG. 11 shows a flowchart for changing the status of a message in response to the table of FIG. 10. Step 230 is entered in response to the time selected in step 210. In step 232 a message is selected in response to the address/message requirement of FIG. 10. Then step 234 checks if the message is locked. If not, step 236 checks if the status of the message corresponds to the conditional status of FIG. 10. If true, step 238 changes the status of the message to correspond to the new status of FIG. 10. From either steps 234, 236 or 238, step 240 checks if all messages have been selected. If not, step 232 selects the next message in the message memory. If true, other paging functions are exited to by step 242.

It should be appreciated that the times specified in steps 156 and 210 may either be repeating times, or times executed once and removed.

FIG. 12 shows truth tables illustrating the status of a received message necessary to delete messages of various statuses already stored in the message memory. Paging receivers have limited memory, and at times received messages may have to delete messages stored in the memory in order to be stored. Table 250 shows possible statuses of messages stored in message memory at the time of reception of a new message. Table 260 shows the status necessary to delete a message having a status corresponding to table 250. The status of table 260 is set by either steps 104 or 106 of FIG. 4. An "X" entry in either table 250 or 260 indicates a don't care state. Line 262 indicates a message with the delete status set (a deleted message) may be replaced with any received message having the delete status cleared. Line 264 shows that a stored message having the alerted status and the read status set (a read message) may be deleted by a received message having the read status and deleted status cleared (an unread message). Line 266 indicates that a stored message having the alerted status set and all other statuses cleared (an unread message) may be deleted by a received message having the protect status set and the delete status clear (a protected message). Line 268 indicates that a message having the alerted and protect statuses set and the held, locked and deleted statuses cleared (a protected message) may only be deleted by a received message having the held and protect statuses set and the delete status cleared (a held protected message). Lines 270, 272 and 274 indicate that messages that are held, unalerted or locked may not be deleted by a received message of any status.

In operation, a received message will be stored by first checking message storage statuses specified by line 262 then 264 then 266 and finally 268. If a received message does not have a status corresponding to table 260, it will not be stored in the message memory. Thus by setting or clearing the read, protect and held statuses of a received message, several message storage priorities for deletion of messages already stored in the memory result. Any of the bits of the status signal of the received message, either included in the message signal or set at the pager may be set or cleared by this invention. For example, a very low priority message could have a received status where the read status is set and all other statuses are clear. Such a message can not delete any messages stored in the pager but may only be stored in memory having already deleted messages, which corresponds to empty memory. If no empty memory were available, the message would not be stored. Alternately, a higher priority may be assigned to a message by clearing the all status bits in the received message (unread message), the received message may only be stored in empty memory or may delete read and alerted messages from the memory. Still higher priority may be realized by setting the protect status of a received message which provides for the deletion of unread and unprotected messages. Setting the hold and protect statuses provides for an even higher priority of message deletion in order to store the received message.

Thus a means for determining one of a plurality of priorities for a received message has been shown. The priority indicating which messages may be deleted in order to store the received message. The status shown in FIG. 12 may be converted to a numerical priority value for determining if a message may be deleted from memory. Thus a received message would have to have a higher priority value in order to delete a message from memory. For example the status of line 262 table 250 could have a priority of 0 while the status of line 262 table 260 could have a priority of 1. Similarly, priorities 2, 4 and 6 could correspond to the statuses of lines 264–268 of table 250 and priorities 3, 5 and 7 could correspond to the statuses of lines 264–268 of table 260. The highest priority in this example could be 8 and assigned to the statuses of lines 270–274 of table 250. In an alternate embodiment, the priority signal may be independent of the status signal and comprise a numerical value. Thus a received message having a first numerical priority may only delete a stored message having a second numerical priority less than the first numerical priority independent of the status of either message. Similar to the received message status, the priority of a received message may be included with the message or set at the receiver in response to the time of day and the address associated with the message. Furthermore, the priority of messages stored in the memory may be varied in response to the time of day and status of the message.

FIG. 13 shows am address signal stored in the code plug with corresponding function times and function signals. This aspect of the invention provides for the changing of the function of an address in response to the time of day. Time signal 300 indicates that the function described by function signal 302 is to be associated with the address at that time. At time 304 the function of the address is to be changed to that of function signal 306. The address is shown by signal 308.

FIG. 14 shows a table relating the function signal to the type of message received by the pager. Column 320 shows a four bit function signal and column 322 shows the corresponding pager format. The formats include tone numeric, alpha numeric and graphic messaging with and without priority, as well as analog and Linear Predictive Coding (LPC) voice messaging. Finally an inactivation function (1111) inhibits the address decoder of the pager from identifying the address from signals within the received paging signal. Additional functions may be added to the table of FIG. 14 as required by the paging system.

FIG. 15 shows an example of the changing functions of an address with respect to time. Signal 330 and 332 indicate that beginning at 8:00 AM, messages will be decoded as priority alpha messages. The priority indicates that an audio alert will be generated in response to the reception of the message even if the pager is set into a silent alerting mode. The alpha function indicates that the message signal after the address is to be decoded as alpha (ASCII) data. Signals 334 and 336 indicate that at 5:00 PM messages will be decoded as numeric messages having no alerting priority. Thus if the pager is set to a silent alert mode, no audio alert will be generated in response to the reception of the message, and the message signal following the address will be decoded as numeric (BCD) information. Finally, Signals 338 and 340 indicate that at 11:30 PM the address is deactivated, thereby not being recognized by the pager. In operation, function signal 332 is reactivated at 8:00 AM the next day. Address signal 342 indicates that the aforementioned functions are assigned to an address corresponding to the telephone number 555-1212.

Any number of time and functions signals may be associated with an address and a code plug may have a plurality of addresses each with associated time and function signals. The paging terminal which transmits the paging message must also be aware of the time of day and the function of an address of the pager in order to properly communicate messages to the pager. Furthermore, the time and function signals 300–306 may either be predetermined, stored in the code plug at the time of programming the address, or within a message received by the pager. Receiving time and function signals from the base station allows the paging system to more efficiently regulate the type of information transmitted to a pager, for example numeric information may be transmitted in busy hours and alpha or graphic information transmitted when the transmitter is not busy, thereby having more time for transmitting longer alpha or graphic messages. Additionally, a transmitter may send the pager a new address with an initial function followed by a time and a deactivation function. This allows the paging system to provide a new service associated with the new address to a pager user for a limited time in order for the user to evaluate the service.

Although the invention has been shown by way of example, numerous modifications may be made to the invention while remaining with in the scope of invention which is defined by the following claims.

We claim:

1. A selective call receiver comprising:

means for receiving a selective call message, the selective call message comprising an address, a message and message status information and received at a first time;

means for storing the message and a message status associated therewith;

means for handling the message in accordance with the message status; and means for automatically changing the message status to one of a plurality of predetermined message statuses, the one of the plurality of predetermined message statuses determined in response to the message status information, wherein the message handling means handles the message in accordance with the one of the plurality of predetermined message statuses after the automatic changing means automatically changes the message status to the one of the plurality of predetermined message statuses.

2. The selective call receiver according to claim 1 further comprising:

indicating means coupled to the message handling means for producing an indication of the reception and storage of the message, wherein the message handling means provides a signal to the indicating means to produce the indication if the message status corresponds to a first one of the plurality of predetermined message statuses, and wherein the message handling means does not provide a signal to the indicating means to produce the indication if the message status corresponds to a second one of the plurality of predetermined message statuses different from the first message status.

3. The selective call receiver according to claim 1 further comprising:

display means coupled to the message handling means for displaying the stored message, wherein the message handling means provides the message to the display means for display thereby in response to the message having a message status corresponding to a first one of the plurality of predetermined message statuses, and wherein the message handling means does not provide the message to the display means in response to a second one of the plurality of predetermined message statuses.

4. The selective call receiver according to claim 1 further comprising user selection means for manually selecting the message status to be associated with the message prior to reception of the selective call message.

5. The selective call receiver according to claim 1 further comprising time keeping means for generating a time of day signal and wherein said means for automatically changing the message status is coupled to said time keeping means for changing the message status of the received message at a second time subsequent to the first time, the second time determined in response to the time of day signal.

6. The selective call receiver according to claim 1 wherein said receiving means includes a means for determining if the address of the selective call message matches a predetermined address; and wherein said mans for automatically changing the message status changes the message status in response to the message status information and the address of the message.

7. The selective call receiver according to claim 6 wherein the message handling means is coupled to the storing means, and wherein the message handling means stores the message if the one of the plurality of predetermined message statuses is a first message status and does not store the message if the one of the plurality of predetermined message statuses is a second message status.

8. The selective call receiver according to claim 1 wherein the means for storing stores a plurality of messages each having message status information associated therewith, and wherein the message handling means comprises deleting means coupled to the receiving means and the storing means for deleting one of the plurality of messages from this storing means in response to the receiving means receiving a selective call message having message status information corresponding to a message status having a value greater than a value of the message status associated with the one of the plurality of messages.

9. A method of assigning a status to a message received by a selective call receiver comprising the steps of:

receiving a selective call message comprising an address, message status information, and the message; and automatically assigning one of a plurality of message statuses to the message for determining how the message will be handled, the one of the plurality of message statuses determined in response to the message status information.

10. The method according to claim 9 further comprising the steps of:

providing an indication signal indicating reception of the message if the one of the plurality of message statuses is determined to be a first predetermined message status; and inhibiting said indication signal if the one of the plurality of message statuses is determined not to be the first predetermined message status.

11. The method according to claim 9 further comprising the step of:

determining a default message status from the plurality of message statuses in response to a manual input at the selective call receiver; and wherein said step of assigning assigns the default message status to the message.

12. The method according to claim 9 wherein the step of assigning assigns a first one of the plurality of message statuses in response to the address corresponding to a first predetermined address and assigns a second one of the plurality of message statuses in response to the address corresponding to a second predetermined address.

13. The method according to claim 9 wherein said step of automatically assigning is made in response to a manual input at the selective call receiver.

14. The method according to claim 9 wherein the selective call receiver further includes a time keeping means for producing a signal indicative of the time of day, the method further comprising the step of:

determining a first default message status, a second default message status and a first time; and wherein said step of assigning assigns the first default message status in response to the time of day signal being before the first time and assigns the second default message status in response to the time of day signal being after the first time.

15. The method according to claim 9 wherein the plurality of message statuses includes a message status indicating the message may not be deleted by a subsequent message.

16. The method according to claim 9 wherein the plurality of message statuses includes a message status indicating the message may not be stored upon reception of the message.

17. A selective call receiver comprising:

means for storing a message and a plurality of characteristics associated with the message including a current message status;

means for handling the message in accordance with the current message status; and means for automatically changing the current message status associated with the message from a first message status to a second message status if a characteristic of the message substantially equals a predetermined characteristic.

18. The selective call receiver according to claim 17 further comprising:

clock means for generating a time signal, wherein said changing means changes the current message status of the message in response to the time signal equaling a predetermined time.

19. The selective call receiver according to claim 18 wherein said predetermined time and said second message status are included within time and message status signals, respectively, within a selective call message comprising the message, and the selective call receiver further comprises means for decoding the time and message status signal from the selective call message for use by said changing means, whereby the plurality of characteristics of the message comprise the time and message status signals.

20. The selective call receiver according to claim 17 wherein said storing means stores a plurality of messages, the characteristic of each message having a unique signal indicative to the message associated therewith, and the predetermined characteristic includes the unique signal indicative of the message.

21. The selective call receiver according to claim 17 wherein the message includes an address signal indicative of the selective call receiver, the selective call receiver having a plurality of addresses assigned thereto, and the plurality of characteristics includes signals corresponding to the plurality of addresses and said predetermined characteristic corresponds to one of the plurality of addresses.

22. A method for changing a current message status of a message stored within a selective call receiver wherein the message is handled in accordance with the current message status thereof, the method comprising the steps of:

comparing a characteristic associated with stored messages to a first characteristic; and automatically changing the current message status of those stored messages having an associated characteristic substantially equal to the first characteristic.

23. The method according to claim 22 further comprising the step of storing a plurality of messages having the characteristic associated therewith and a message status corresponding to each of the plurality of messages; and wherein said step of comparing further comprises comparing the message status of the plurality of messages to a first message status; and wherein said step of changing automatically changes the message status of messages within the plurality of messages which have the first message status corresponding thereto.

24. The method according to claim 23 wherein the first message status corresponds to a message having been read by an operator of the selective call receiver and a second message status corresponds to the message being deleted from the selective call receiver.

25. The method according to claim 23 wherein the first message status corresponds to inhibiting an indication that a message has been received an stored and a second message status enables said indication.

26. The method according to claim 22 wherein the selective call receiver has a plurality of predetermined address signals assigned thereto and the message has an address signal associated therewith matching one of the plurality of address signals, and wherein the characteristic associated with the message corresponds to said address signal.

27. The method according to claim 22 wherein said step of comparing is performed in response to a manual input made at the selective call receiver.

28. The method according to claim 22 wherein the selective call receiver further includes a time keeping means for producing a signal indicative of the time of day, further wherein said step of comparing is performed in response to the time of day signal being equal to a predetermined time.

29. A selective call receiver comprising:

means for storing a first message having a first hierarchical message priority;

means for receiving a selective call message comprising a second message;

means for automatically selecting from a plurality of hierarchical message priorities, a second hierarchical message priority for the second message;

means for generating a time of day signal;

means for changing the first hierarchical message priority in response to the time of day signal; and means for selectively automatically deleting the first message in response to the second message having the second hierarchical message priority.

30. The selective call receiver according to claim 29 further comprising:

clock means for generating a time of day signal; and means for changing the first hierarchical message priority in response to the time of day signal;

31. The selective call receiver according to claim 29 wherein selective call message includes the second message and a signal indicative of the hierarchical message priority of the second message and said selecting means assigns the second hierarchical message priority in response to the signal.

32. The selective call receiver according to claim 31 wherein the signal further indicates the status of the second message and the selecting means selects the second hierarchical message priority in response to the hierarchical message priority and the status of the second message.

33. The selective call receiver according to claim 29 further comprising input means for manually inputting a user selection signal into the selective call receiver; wherein the selecting means selects the second hierarchical message priority in response to the user selection signal.

34. The selective call receiver according to claim 29 further comprising a clock means for generating a time of day signal; wherein said assigning means assigns the second hierarchical message priority in response to the time of day signal.

35. The selective call receiver according to claim 34 further comprising means for changing the first hierarchical message priority in response to the time of day signal.

36. A receiver for receiving an information signal, said information signal being formatted in one of a plurality of formats, the receiver comprising:

clock means for producing a time signal;

format selecting means for selecting a format from the plurality of formats in response to the time signal; and means for decoding the information signal in the format selected by said format selecting means.

37. The selective call receiver according to claim 36 wherein said plurality of formats includes an alpha format and a numeric format wherein the information is formatted in ASCII and BCD formats, respectively.

38. The receiver according to claim 36 wherein an address signal precedes the information signal, the address signal selectively identifying the receiver for receiving the information signal, the receiver further comprising:

memory means for storing a predetermined address identifying the receiver;

comparison means for comparing the address signal with the predetermined address and for generating a detect signal in response to the address signal being substantially equal to the predetermined address; and wherein said means for decoding decodes the information signal in response to the detect signal.

39. The receiver according to claim 36 further comprising:

memory means for storing a plurality of event signals and a corresponding plurality of function signals; wherein said format selecting means comprises:

determining means for comparing the time signal with the plurality of event signals to determine if the time signal correlates with any of the plurality of event signals; and selecting means for selecting the format in response to one of the plurality of function signals corresponding to one of the plurality of event signals correlating with the time signal.

40. The receiver according to claim 39 wherein the one of the plurality of function signals inhibits said decoding means from decoding the message.

41. The receiver according to claim 39 wherein the information includes at least one event signal and a corresponding function signal and the receiver further comprises a means for detecting the at least one event signal and corresponding function signal and for storing the at least one event signal and corresponding function signal in said memory means.

42. A selective call receiver for receiving a paging signal having an address signal, the selective call receiver comprising:

clock means for producing a time of day signal;;

memory means for storing a predetermined address and an enable time and a disable time;

receiving means for receiving and demodulating the paging signal; and decoding means for detecting an address signal equal to the predetermined address in response to the time of day signal having a value between the enable and disable times, and for not detecting the address signal in response to the time of day signal having a value not between the disable and enable times.

43. The receiver according to claim 42 wherein said memory means stores a second predetermined address, and said decoding means further detects an address signal equal to the second predetermined address independent of the enable and disable times.

44. A selective call receiver, comprising:

means for receiving messages;

means for storing received messages and a message status associated with each received message;

means for handling stored messages in accordance with the message status associated therewith; and means for automatically changing the message status of certain stored messages to another message status identified by a manual input means, wherein the handling means handles the certain stored messages in accordance with the another message status after the automatic changing means automatically changes the message status thereof to the another message status.

45. A selective call receiver, comprising:

means for receiving messages and initial current message statuses associated therewith;

means for storing received messages and a current message status associated with each received message, wherein initially the current message status of received messages are the associated initial current message statuses received therewith;

means for automatically changing the current message status of certain stored messages having a characteristic identified by a manual input means; and means for handling stored messages in accordance with the current message statuses stored therewith.

* * * * *